United States Patent [19]

Arlauskas et al.

[11] Patent Number: 4,475,754

[45] Date of Patent: Oct. 9, 1984

[54] PULL OUT DOOR HANDLE ASSEMBLY

[75] Inventors: Alfonsas Arlauskas, Troy; Algis G. Augunas, Warren, both of Mich.

[73] Assignee: General Motors Corporation, Detroit, Mich.

[21] Appl. No.: 376,398

[22] Filed: May 10, 1982

[51] Int. Cl.[3] ..... E05C 13/00

[52] U.S. Cl. ..... 292/336.3

[58] Field of Search ..... 292/336.3, 347, 23, 292/223, 226, 123, 126, DIG. 71, DIG. 49

[56] References Cited

U.S. PATENT DOCUMENTS

| | | | |
|---|---|---|---|
| 2,117,160 | 5/1938 | Gale . | |
| 2,331,403 | 10/1943 | Leonard . | |
| 2,485,000 | 10/1949 | Jakeway . | |
| 2,736,596 | 2/1956 | Burke | 292/DIG. 71 |
| 3,159,415 | 12/1964 | Sandor | 292/336.3 |
| 3,993,338 | 11/1976 | Cherbourg et al. | 292/DIG. 49 X |

*Primary Examiner*—Richard E. Moore

*Attorney, Agent, or Firm*—Patrick M. Griffin

[57] ABSTRACT

A pull out type door handle assembly includes a mounting member attached to a vehicle door and a generally U-shaped handle pivoted thereto at a first leg with a second leg extending through an aperture in the mounting member and having the shoulder thereon engaged with the peripheral flange of the aperture to limit the inward rotation of the handle and define the inoperative position thereof. The second leg includes a lateral extension spaced from the inner side of the mounting member and engageable with one arm of a bell crank lever pivoted to the inside of the mounting member. The other arm of the lever is connected to a latch release lever. A spring rotatably biases the one arm of the bell crank lever into engagement with the lateral extension to maintain the handle in inoperative position. As the handle is rotated outwardly of the mounting member, the one bell crank lever arm engages the inner side of the mounting member to define the operative position of the handle and release the vehicle latch. The spring returns the bell crank lever and handle to inoperative position upon release of the handle.

2 Claims, 4 Drawing Figures

PULL OUT DOOR HANDLE ASSEMBLY

This invention relates to door handle assemblies and more particularly to a pull out door handle assembly for actuating the latch release mechanism of a vehicle door lock.

BACKGROUND OF THE INVENTION

Gale U.S. Pat. No. 2,117,160, Leonard U.S. Pat. No. 2,331,403 and Jakeway U.S. Pat. No. 2,485,000 all disclose pull out type door handle assemblies having a handle which is rotatable between inoperative and operative positons for actuating a latch release mechanism.

SUMMARY OF THE INVENTION

The pull out door handle of the subject invention includes a mounting member having a handle pivoted to the outside thereof and a latch release mechanism pivoted to the inside thereof which cooperatively interact with the mounting member and one another to define and limit the rotation path of the handle and of the latch release mechanism. In the preferred embodiment, a mounting member has an outer wall and an inner wall matching the outer contour of the vehicle door. The member is mounted to the door. A generally U-shaped handle projects outwardly from the mounting member and has a first leg pivoted to the mounting member and a second longer leg extending closely through an aperture in the mounting member to the inside thereof. A gripping portion interconnects the two legs and is spaced from the outside wall of the mounting member. The second leg also includes an extension spaced from the inside wall of the mounting member. The latch release mechanism includes a bell crank lever pivoted to the inside wall of the mounting member, with one arm mounting a roller engageable by the extension on the second leg of the handle and the other arm adapted to be connected to a latch release rod.

A spring continually biases the bell crank in a direction to engage the roller on the one leg thereof with the extension on the second leg to locate the bell crank lever in a normal or inoperative position. This also engages a shoulder on the second leg with the outer wall of the mounting member around the aperture therethrough to locate the handle in a normal or inoperative position. As the handle is gripped by an operator and pulled outwardly of the mounting member and door, the handle rotates about the pivot of the first leg to the mounting member and the engagement of the extension on the second leg with the roller on the one arm of the bell crank lever rotates the lever relative to the mounting member against the force of the spring. Ultimately, the roller on the one arm of the bell crank lever engages the inside wall of the mounting member as the other arm of the bell crank lever moves the latch release rod to release the door latch. With release of the handle, the biasing spring returns both the bell crank lever and handle to their respective inoperative positions.

It is therefore the primary object of the invention to provide an improved pull out type door handle assembly in which a mounting member, handle and a latch release mechanism interact cooperatively to define and limit the path of the handle and the release mechanism and locate each in both inoperative and operative positions.

DESCRIPTION OF THE DRAWINGS

This and other objects will be apparent from the following specification and drawings wherein.

DESCRIPTION OF THE PREFERRED EMBODIMENT

Figure 1:
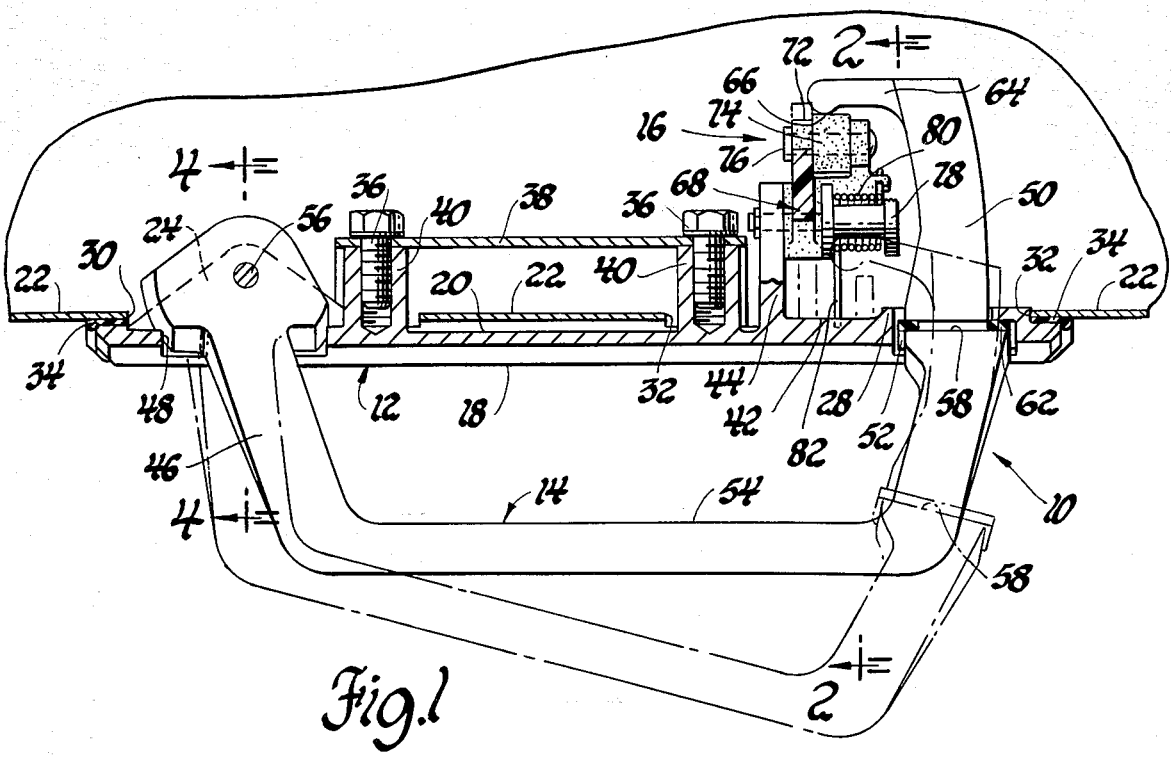
FIG. 1 is a partial longitudinal sectional view of a vehicle door having a pull out type door handle assembly according to this invention mounted thereto, with the handle of the assembly being shown in full lines in inoperative position and in dash lines in operative position.

Referring to FIG. 1, the door handle assembly 10 of the invention includes a mounting member 12, a generally U-shaped handle 14 and a latch release mechanism 16. Mounting member 12 includes an outer, visible wall 18 and an inner non-visible wall designated generally 20 to which several other structures are integrally molded which serve to attach mounting member 12 to outer door panel 22. Inner wall 20 includes a pair of apertured flanges 24 at one end thereof, FIG. 4, and a pair of ribs 26 which border a thickened embossment 28 at the other end thereof. Flanges 24 and 26 lie in horizontal planes and extend angularly to the inner wall 20 to compensate for the sloping of the door panel 22. Flanges 24 and ribs 26 fit within respective apertures 30 and 32 in panel 22. A sealing gasket 34 extends around the wall 20 adjacent the periphery of member 12 to seal member 12 to door panel 22. Member 12 is secured to panel 22 by bolts 36 which pass through a reinforcing member 38 on the inside of the vehicle door and are threaded into a pair of threaded sleeves 40 which extend from inner wall 20. Inner wall 20 also includes a sloped embossment 42 adjacent to an apertured flange 44, best seen in FIG. 2, the function of which will be described below.

Figure 2:
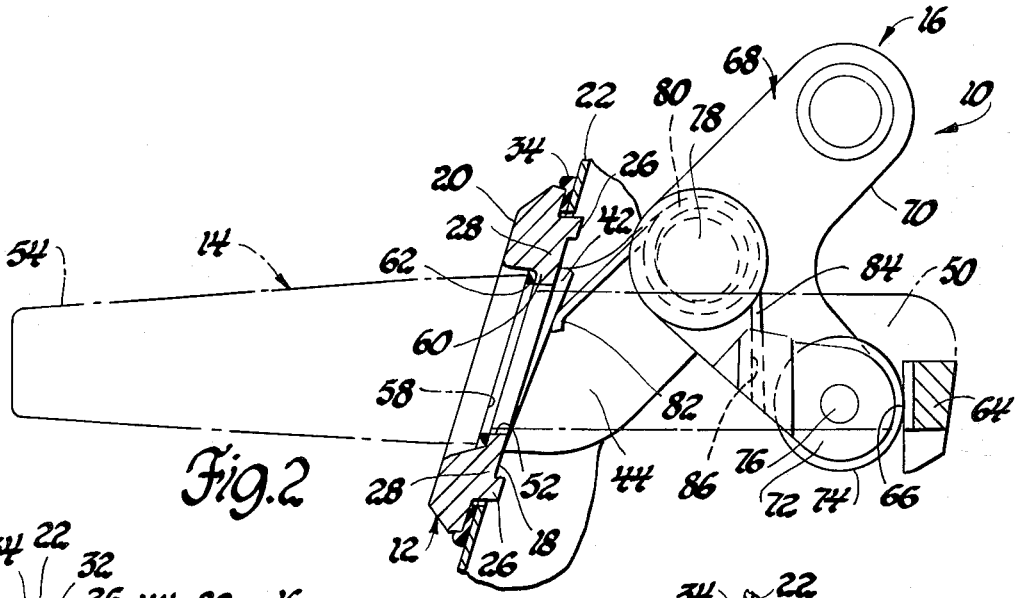
FIG. 2 is an enlarged sectional view taken along line 2—2 of FIG. 1.
Figure 4:
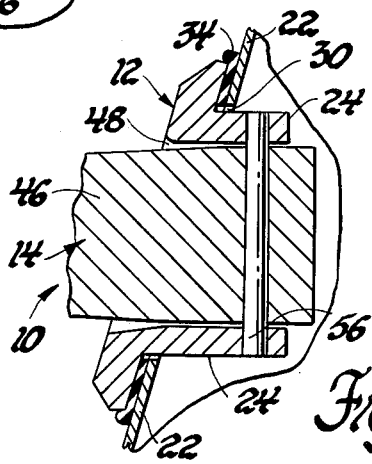
FIG. 4 is an enlarged sectional view taken along line 4—4 of FIG. 1.

Handle 14 includes a first leg 46 which extends through an aperture 48 in mounting member 12 between flanges 24, a second longer leg 50 which extends through an aperture 52 between ribs 26, and a gripping portion 54 interconnecting the legs and located outside mounting member 12. First leg 46 is pivoted by pin 56 to flanges 24, the lower flanges 24 being longer to accommodate the angle of mounting member 12, so that handle 14 may be horizontally pivoted, as best seen in FIG. 4. As best seen in FIG. 2, leg 50 is reduced in cross-section as it passes through aperture 52 to thereby define shoulder 58. Aperture 52, as also seen in FIG. 2, is surrounded by a peripheral flange 60 on three sides thereof. A gasket 62 seats against the shoulder 58 and engages flange 60 to locate handle 14 in its normal inoperative position shown in full lines in FIG. 1. The end of leg 50 includes a lateral extension 64 which terminates in a rounded contact member 66 spaced from inner wall 20 and located between leg 50 and flange 44. As handle 14 is pulled outwardly of mounting member 12 and leg 46 rotates about pin 56, contact member 66 moves toward the inner wall 20.

Latch release mechanism 16 includes a bell crank lever designated generally 68 which, as seen in FIG. 2, includes a first arm 70 apertured to receive a latch release rod, not shown, and a second arm 72. As best seen in FIG. 1, arm 72 includes a clevis having a contact roller 74 pivoted on pin 76 between the legs thereof and engageable with contact member 66. Bell crank lever 68 is pivoted by a headed pin 78 to flange 44. A torsion biasing spring 80 is wrapped around headed pin 78 with one leg 82 engaged against sloped embossment 42 and the other leg 84 engaging in a groove 86 of an extension of second arm 72. Thus, bell crank lever 68 is biased rotationally to continually engage contact roller 74 with contact member 66, and to engage gasket 62 with flange 60 to thus maintain handle 14 in its inoperative position shown in full lines in FIG. 1.

Figure 3:
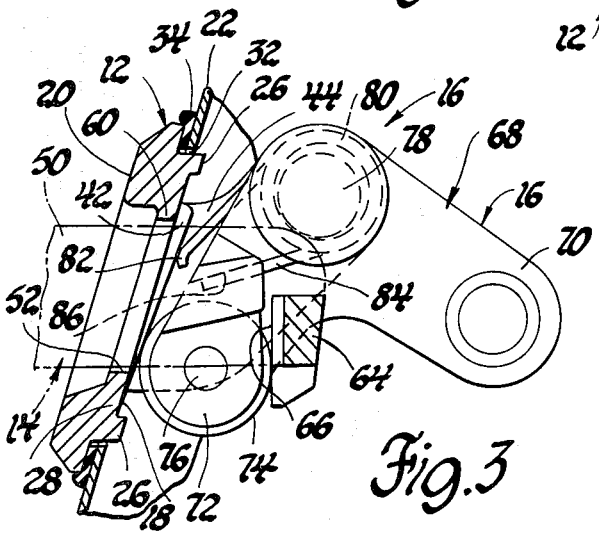
FIG. 3 is a partial view similar to FIG. 2 showing the handle assembly in operative position.

In operation, as handle 10 is rotated outwardly, contact member 66 moves axially along contact roller 74 from the left end thereof to the right end thereof, FIG. 1, as lever 68 rotates clockwise and leg 50 moves through flange 60. Ultimately, roller 74 engages sloped embossment 42 below leg 82 of spring 80, FIG. 3, to locate handle 10 in the operative, dotted line position of FIG. 1 wherein the door latch is released. Upon release of the handle 10 the force of spring 80 rotates bell crank lever 68 counterclockwise as contact member 66 moves along roller 74 and shoulder 58 reengages flange 60 in the solid line or inoperative position of FIG. 1.

Thus, the interaction of the mounting member, the handle and the latch release mechanism serves to limit and define the rotation path of both the handle and the latch release mechanism.

The embodiments of the invention in which an exclusive property or privilege is claimed are defined as follows:

1. A pull out type door handle assembly comprising, in combination, a mounting member, a generally U-shaped operating handle located outwardly of the mounting member and having the legs thereof extending through apertures in the mounting member to the inner side thereof, means pivotally mounting one leg of the handle to the mounting member, cooperating engageable stop means on the other leg of the handle and the mounting member adjacent the aperture therethrough limiting rotational inward movement of the handle to locate the handle in inoperative position, the other leg of the handle including a lateral extension located in spaced relation to the inner side of the mounting member, a bell crank lever pivoted to the mounting member and located between the extension and the inner side of the mounting member, means adapted to connect one leg of the lever to the release mechanism of a vehicle door lock, resilient means rotatively biasing the bell crank lever relative to the mounting member to engage the other leg thereof with the lateral extension and rotate the operating handle inwardly of the mounting member to engage the cooperating stop means and locate the operating handle in inoperative position, the lateral extension rotating the bell crank lever against the action of the resilient means upon manual movement of the handle outwardly of the mounting member to operative position, the other leg of the bell crank lever being engageable with the inner side of the mounting member and the lateral extension in view of the location of said bell crank lever therebetween to limit outward movement of the handle and locate the handle and the bell crank lever in operative position.

2. A pull out type door handle assembly, comprising, in combination, a mounting member, a generally U-shaped operating handle having one leg pivoted to the mounting member, a longer second leg extending through an aperture in the mounting member to the inner side thereof and a grip portion interconnecting the two legs and located to the outer side of the mounting member, the second leg including a shoulder portion engageable with a peripheral flange of the mounting member aperture to limit inward rotational movement of the handle and locate the handle in inoperative position, the second leg further including a lateral extension thereon located in spaced relation to the inner side of the mounting member and terminating in a contact member, a bell crank lever pivoted to the inner side of the mounting member located between said lateral extension and said inner side of the mounting member and having a first arm adapted to be connected to a latch release lever and a second arm having a contact roller pivoted thereto and engageable with the contact member of the second handle leg, a spring engaged between the inner side of the mounting member and the bell crank lever to rotatably bias the contact roller into the contact member and maintain the handle in inoperative position, manual movement of the handle outwardly of the mounting member rotating the handle about the first leg pivot and moving the contact member axially along the contact roller to move the second arm of the bell crank lever toward the inner side of the mounting member until said second arm engages said inside face of the mounting member in view of the bell crank lever's location between said lateral extension and said inner said of the mounting member, to thereby define the operative position of the handle and the bell crank lever, whereupon the vehicle latch is released, the spring rotating the bell crank lever to relocate the handle and the bell crank lever in inoperative position upon manual release of the handle.

* * * * *